United States Patent [19]

Bitzer

[11] Patent Number: 4,628,950

[45] Date of Patent: Dec. 16, 1986

[54] CONTAINER FOR AN APPLICATOR MASS, PARTICULARLY FOR A TOILET PRODUCT OR A COSMETIC PRODUCT

[76] Inventor: Reiner Bitzer, Am Momartsberg 1a, D-6123 Bad König 2, Fed. Rep. of Germany

[21] Appl. No.: 580,716

[22] Filed: Feb. 16, 1984

[30] Foreign Application Priority Data

Feb. 18, 1983 [DE] Fed. Rep. of Germany ..... 3305669

[51] Int. Cl.[4] ..... A45D 34/04

[52] U.S. Cl. ..... 132/88.7; 132/DIG. 3; 401/122

[58] Field of Search ..... 132/88.5, 88.7, DIG. 3, 132/79 A; 401/118, 121, 122, 126, 129, 130

[56] References Cited

U.S. PATENT DOCUMENTS

| | | | |
|---|---|---|---|
| 3,214,782 | 11/1965 | Masters et al. | 401/122 |
| 3,471,244 | 10/1969 | Melocchi | 401/122 |
| 3,908,675 | 9/1975 | Spatz et al. | 401/122 |
| 3,921,650 | 11/1975 | Montgomery | 132/88.7 |
| 3,930,280 | 1/1976 | Vasas | 401/122 |
| 4,175,574 | 11/1979 | Zulberti | 132/88.7 |
| 4,332,494 | 6/1982 | Kingsford | 132/88.7 |
| 4,390,298 | 6/1983 | Carluccio | 132/88.7 |
| 4,403,624 | 9/1983 | Montgomery | 401/122 |
| 4,404,977 | 9/1983 | Vasas | 132/88.7 |
| 4,433,928 | 2/1984 | Kingsford | 401/122 |
| 4,470,425 | 9/1984 | Gveret | 132/88.5 |

FOREIGN PATENT DOCUMENTS

| | | |
|---|---|---|
| 2301 | 6/1979 | European Pat. Off. . |
| 2722232 | 11/1978 | Fed. Rep. of Germany . |
| 1320865 | 2/1963 | France . |
| 2222048 | 10/1974 | France . |

*Primary Examiner*—Paul J. Hirsch

*Attorney, Agent, or Firm*—Spencer & Frank

[57] ABSTRACT

The invention relates to a container for an applicator mass, particularly for a toilet product or a cosmetic product, the container including a reservoir vessel 12, a closure 14, an applicator 30 which is immersible into the reservoir vessel, and an applicator mass stripper 80 which can be brought into engagement with the applicator. Applicator 30 and stripper 80 are designed and arranged relative to one another in such a manner that if the rotation angle orientation of applicator 30 relative to stripper 80 is different, the length of the circumference of the applicator which is in stripping engagement with the stripper is different. An additional apportioning stripper 60 may be provided to keep clean shaft 32 of applicator 30.

40 Claims, 15 Drawing Figures

CONTAINER FOR AN APPLICATOR MASS, PARTICULARLY FOR A TOILET PRODUCT OR A COSMETIC PRODUCT

BACKGROUND OF THE INVENTION

The invention relates to a container for an applicator mass, particularly for a toilet product or a cosmetic product, the container including a reservoir vessel, a closure, and an applicator mass stripper which can be immersed into the reservoir vessel and brought into engagement with the applicator.

Such containers are known, from which different quantities of applicator mass can be removed. The setting for the quantity to be removed is effected according to two principles:

(a) changing the cross-sectional area of the opening through which the applicator passes (U.S. Pat. No. 3,209,388 and European Patent No. 78/200,323, Publication No. 2301); and (b) changing the quantity to be taken up by the applicator (U.S. Pat. No. 3,998,235).

This always involves changing a characteristic geometric value of the container, namely the opening in the first case and the axial distance between the coating faces in the second case.

SUMMARY OF THE INVENTION

It is the object of the invention to design a container for an applicator mass, particularly for a toilet product or a cosmetic product, so that the quantity of applicator mass removed is selectable without changing a characteristic geometric value and by means of familiar removal procedures, namely rotating and/or pulling out the respective handle portion (pulling out and rotating in one or the other sequence).

This problem is solved in that the applicator and the stripper are designed and arranged relative to one another in such a manner that with a different rotation angle orientation of the applicator relative to the stripper the circumferential length of the applicator in stripping engagement with the stripper is different.

In this way it is possible to vary the removal quantity without having to change a characteristic geometric value. The applicator merely needs to be given a certain rotation angle orientation with respect to the stripper, by which the stripping effect can be increased or decreased and thus more or less applicator mass can be removed. No additional setting means are required for this change in the relative position of stripper and applicator so that the configuration of the container according to the invention can be of a particularly simple design.

Locally different engagement depths are here possible in the region of the stripping engagement. However, it is also possible to change at least approximately abruptly from engagement to nonengagement and, depending on the type of the desired application of the applicator mass, it can be attempted to produce more local changes in quantity along the circumference of the applicator and/or a global change in the total quantity taken up.

Compared to containers in which a characteristic geometric value is changed, the container according to the invention is also subject to less wear since the number of moving parts and those in frictional engagement is greatly reduced. Moreover, the number of parts of the container as a whole is reduced.

Manipulation of the container is likewise substantially simplified since special measures for changing a characteristic geometric value are eliminated. Rather, it is merely necessary to select the relative position of applicator and stripper with respect to one another, which requires at most a familiar rotary movement of the handle, perhaps the cap, the closure or a separate part, e.g. a separate applicator handle which is independent of the closure.

Since for the container according to the invention, where the characteristic geometric values remain constant, only stripper and applicator are moved relative to one another, the container according to the invention is suitable for various removal purposes, e.g. for different applicator masses and application surfaces. In the simplest case, disregarding an exchange of applicator mass, it is merely necessary to employ a different, suitable applicator. For manufacture it is then only necessary to have available various types of applicators which are mounted on the respective containers. It is also conceivable to hold available various applicators of different types or having different geometric designs for different application purposes which applicators are then employed for removal from a certain reservoir vessel, depending on the particular application. In this way, the container according to the invention can be used in an extremely versatile manner.

The respectively provided sole stripper of the known containers is able to solve the dual problem of dosaging, on the one hand, and cleaning the applicator shaft, on the other hand, only by compromise and, regarding cleaning of the applicator shaft in particular, in practice often only insufficiently. For this case, the invention provides, an additional apportioning stripper which measures the applicator mass to be taken up primarily by the applicator (as a whole or locally) to a 100% value, which is reduced to much less than one-half, depending on the angular position of the applicator relative to the first stripper, with the minimum value being given by the minimum quantity of applicator mass required for one application, which may even be, for example, 1%. Thus, the applicator mass may expediently be graduated in steps of 40, 70 and 100%. In particular, the apportioning stripper is also provided for keeping the shaft clean and it prevents material from being pressed out. For this purpose, the apportioning stripper is preferably made of an inherently flexible plastic, for example of polyethylene, PVC, polypropylene and the like. The preferred mount for the shaft in the apportioning stripper is a press-fit mount so that, due to its inherent elasticity, the apportioning stripper can adapt itself to the not 100% round shaft.

The apportioning stripper further serves to guide the shaft during its removal.

Moreover, during the removal movement, the apportioning stripper comes into engagement with the applicator so that excess applicator mass which may be present at or in the applicator is stripped off. Thus, this apportioning stripper limits the quantity of applicator mass to be removed by the applicator to a defined quantity which again, according to the invention, can be selected below a fixed maximum value. Thus the additional stripper is also appropriate if no applicator shaft cleaning is required.

According to a preferred embodiment of the invention, both strippers are designed to be integrated, preferably in one piece. This makes possible an especially compact arrangement and shortens assembly time. In this embodiment, it is also possible to initially preassemble the two strippers and to then mount them together in the container. For the one-piece design, there is the advantage that material is saved.

In another embodiment of the invention, both strippers are arranged to be spatially separated from one another. This makes it possible to optimally design the apportioning stripper and the stripper for their respective intended uses and to arrange them in the container so that the maximum effect can be realized. It is also possible, in particular, to design and mount the apportioning stripper in the same manner as is the case in customary containers of this type which have no possibility of selecting the quantity to be removed. In this way, manufacture of the containers can be made more cost-efficient, in that as many identical parts as possible are used for the simple and comfortable container with selection possibility.

It is preferred that both strippers are arranged in the neck of the container.

Preferably, at least one stripper is made in one piece with the container, thus simplifying manufacture and assembly, which is a great advantage for such mass-produced articles.

Depending on its intended use, the applicator may have different shapes, with particularly its cross section being freely adaptable to the respective purpose. For example, the cross section of the applicator may be symmetrical or asymmetrical, circular or angular. Its shape also depends on whether the outer circumference of the applicator will be charged with applicator mass, which is then in part stripped off by more or less intensive engagement, or whether the applicator is also charged far into its interior and the stripper is to remove applicator mass from the interior of the applicator by a kind of squeezing effect. Depending on the shape of the cross section and the configuration of its circumferential profile in depth in conjunction with a corresponding shape of the stripper, it is possible to provide different selectable steps regarding number and possible graduations. A preferred embodiment of the applicator cross section resides in that the applicator is provided with a single or multiple sequence of sectors having different radii. In a particularly simple design, the applicator cross section has the shape of a circle segment which encloses an angle of more than 180°. This makes it possible, for example, to employ a conventially, axially symmetrically prefabricated applicator and to modify it according to the invention by removing material along its circumference.

The relative movement of applicator and stripper may be effected in such a manner that the axis of rotation remains unchanged with respect to the container axis. However, it is also possible, to vary the distance from the stripper and thus the degree of stripping engagement. In this embodiment of the invention, an applicator having a circular disc cross section is preferably employed, with the axis of the applicator being disposed concentric with the handle (cap, closure or separate member). In this embodiment, an applicator can be used, for example, as it is also used in the simpler containers without possibility to select the removal quantity so that subsequent working of the applicator itself can be omitted. Moreover, this embodiment makes it possible to utilize, if necessary, an existing edge of the container itself as the stripper. Alternatively, the axis of the applicator having a circular disc cross section could also be placed at the handle in an off-center arrangement.

The cross section, particularly the cross-sectional shape of stripper and applicator, is freely selectable depending on the intended use. Preferred, is a cross-sectional shape in which the free passage cross section of the stripper is similar to the cross section of the applicator. In this case, the two cross sections may have evolved, for example, from a mathematical similarity transformation. However, it is also possible to combine an applicator having, for example, a semicircular cross section with a stripper having a rectangular cross section.

Preferably, the overlap area of stripper and applicator is variable in the embodiment in which the stripping engagement occurs in the manner of squeezing into the applicator. Of particular advantage is an embodiment in which, by suitable selection of the overlap areas in the cross-sectional profile, various removal quantities can be favorably preselected.

To compensate for wear, the stripper may be made adjustable to the desired intended value.

Preferably the applicator is designed in the known and conventional manner as a brush. However, it may also be designed as a sponge, cushion etc., and may be particularly suitable for taking up applicator mass on its circumference. It is particularly advisable to make the applicator of plastic or leather.

In order to determine various selectable graduations, the container according to the invention is preferably equipped with one or a plurality of detent positions for rotation angle orientations of the applicator relative to the stripper. This enables the user to rotate the applicator handle until it reaches a desired detent position which can be felt and then to remove the desired quantity of applicator mass with the applicator without having to observe the container for this purpose. Alternatively, or in addition hereto, it is advisable, however, to mark the container optically and/or by an adjustable final abutment with preferred rotation angle orientations for the applicator relative to the stripper for certain quantities to be removed. In this case, the user can rotate the handle of the applicator until a certain position at a marker has been set and can then remove the applicator from the container with the preselected quantity of applicator mass.

A threaded closure is preferred for the container, it being advisable to employ a short-start thread with cams. The thread may also be provided with an adjustable abutment which likewise permits prior setting of the degree of removal and makes the container possibly adaptable for other purposes, for example for a different applicator mass or a different applicator. Instead of a thread, however, a snap closure may also be provided.

It is particularly advisable to employ the container according to the invention for powder, mascara and lipstick masses. However, it can also be used to advantage for adhesives, paints, liquids, other liquid media, pastes and other viscous or pasty media, powders and further applicator masses.

Further advantages of the invention will become evident from the description of embodiments in conjunction with the drawing, as will be explained below.

DESCRIPTION OF THE PREFERRED EMBODIMENTS

Figure 1:
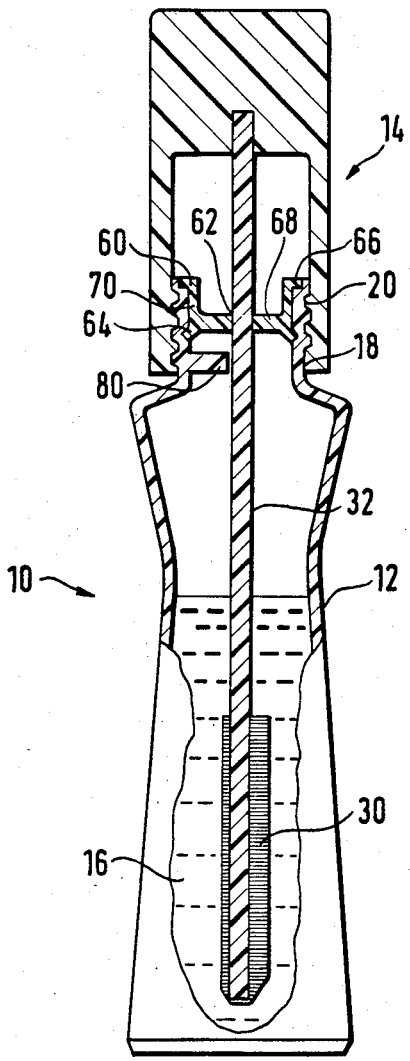
FIG. 1 is a partial sectional view of a container according to the invention.

FIG. 1 shows a container 10 composed of a reservoir vessel 12 for the applicator mass 16, mascara in the illustrated embodiment, and a closure 14. Axially fastened to closure 14 in the usual manner is an elongate shaft 32 equipped with an applicator 30 at its end facing away from closure 14. The closure is screwed to the neck 18 of reservoir vessel 12 by means of a thread 20. In the illustrated embodiment, the closure serves as a handle for the applicator.

Arranged at the top of neck 18 of vessel 12, there is an apportioning stripper 60 of cup-shaped design. In the planar bottom 68 of apportioning stripper 60 there is an opening 62 through which passes the shaft 32 of applicator 30. Opening 60 is dimensioned in such a way that shaft 32 is in a press fit with apportioning stripper 62, thus preventing material from being pressed out of reservoir vessel 12 and simultaneously keeping the shaft clean. At the lower outer edge of the cylinder, extending outwardly in a ring around the cylinder, there is a detent tongue which is in engagement with a corresponding recess in the inner wall of neck 18 of reservoir vessel 12 and serves to hold the apportioning stripper. An outwardly extending lip 66, extending outwardly above neck 18, is disposed at the upper edge of the vertically oriented part 70 of the stripper. The apportioning stripper is made of an elastic material, e.g. neoprene rubber, PVC or the like.

Disposed at the bottom of neck 18 of reservoir vessel 12 and made in one piece therewith is a stripper 80 which is not symmetrical and which, in the illustrated sectional view of the embodiment, extends inwardly only to the left of shaft 32 of applicator 30 and has, for example, the shape of a circle segment. In the illustrated embodiment, the stripper is extruded into the neck and is made of any desired material, hard rubber, plastic, coated material, glass, etc. If desired, the stripper may be somewhat elastic. Stripper 80 need not necessarily be disposed in the bottom of neck 18 of reservoir vessel 12; the only requirement is that it be disposed above the level of the supply of applicator mass. It is also possible, for example, to design stripper 80 in such a manner that it extends less far toward the axis of the container and therefore two such strippers are provided at the same height.

In the illustrated embodiment, applicator 30 is a brush whose cross section is asymmetrical. The bristles are shorter on the left in FIG. 1 than on the right. In this embodiment, for example, 220° of the circumference of the applicator remain unchanged while brush material has been removed from the remainder of the circumference so that the applicator has a flattened side and a full side (see also FIG. 2).

For the removal of applicator mass, closure 14 must be unscrewed. Thereafter, by further rotation to a marker (not shown), the desired degree of stripping is preselected and the desired quantity is then removed by way of a lifting movement, i.e. pulling shaft 32 with applicator 30 out of the container.

FIGS. 2A, 3A, 4A and 5A show the cross-sectional area not covered by apportioning stripper 60 and neck 18, which is the maximum available area for the passage of applicator 30. To illustrate the invention, the depicted shapes have been selected from a plurality of possible shapes and constitute preferred possibilities.

FIGS. 2B, 3B, 4B and 5B show the corresponding cross-sectional areas of applicator 30 which are of similar design. They may be smaller than the cross sections shown respectively in FIGS. 2A, 3A, 4A and 5A, if the stripper is intended to, so to speak, carry away applicator mass; and they may be larger, if the stripper is to remove applicator mass from the interior of applicator 30 in a quasi squeezing manner.

FIGS. 2C, 3C, 4C and 5C each show a relative position of the respective applicator and the opening available for the applicator, with the applicators each having been rotated by 180° (FIG. 2C), 60° (FIG. 3C), 45° (FIG. 4C) and 45° (FIG. 5C), to obtain the maximum effective engagement. The hatched areas illustrate the portion of the cross section of the applicator, charged with applicator mass, which is in effective engagement with stripper 80.

Figures 2A, 2B, 2C, 3A, 3B, 3C, 4A, 4B, 4C, 5A, 5B, 5C, 6A, 6B:
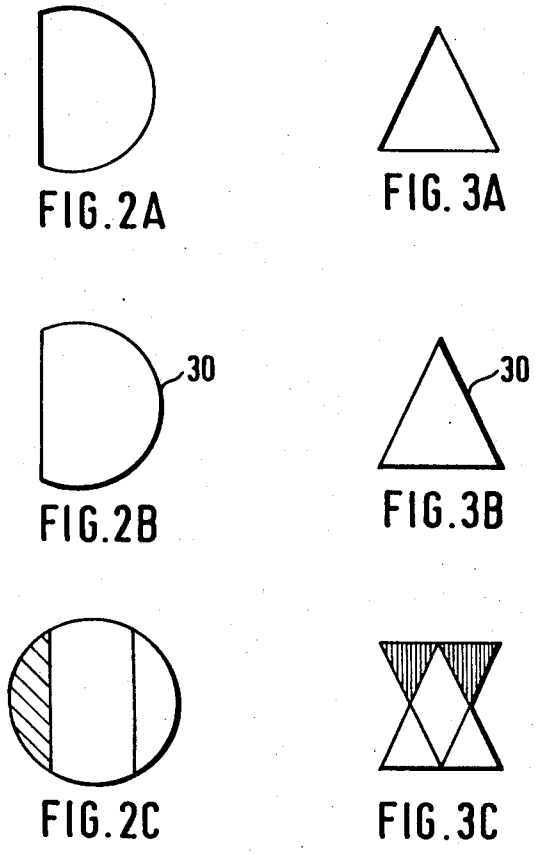
FIGS. 2A, 3A, 4A, and 5A schematically illustrate the cross-section of a passage opening formed by the neck of the container and the stripper.
FIGS. 2B, 3B, 4B, AND 5B schematically illustrate the cross section of an applicator paired therewith.
FIGS. 2C, 3C, 4C, and 5C schematically illustrate the additional cross-sectional area for stripping realized by rotating the applicator relative to the sripper.
FIG. 6A schematically illustrates an extreme position of relative rotation of an applicator/stripper pair for a minimum stripped quantity.
FIG. 6B schematically illustrates an extreme position of relative rotation of an applicator/stripper pair for a maximum stripped quantity.

FIG. 6A and 6B show, for a further embodiment, two different rotation angle positions of stripper 80 and applicator 30. In the illustrated embodiment, the cross-sectional area of the applicator is larger than that of the stripper so that the engagement occurs in a quasi squeezing manner and the stripper performs the function of the apportioning stripper and simultaneously the dosaging function according to the invention. The cross-sectional shapes of stripper and applicator are similar. They exhibit a type of star or wave profile, respectively. In FIG. 6A, the tips of this wave profile of applicator 30 and stripper 80 are oriented radially toward one another so that in this position a minimum quantity of applicator mass is stripped. In FIG. 6B, applicator 30 has been rotated by 30° with respect to stripper 80 so that now the inwardly oriented recesses in the profile of applicator 30 are radially aligned with the outwardly oriented projections in the profile of stripper 80. In this arrangement, the quantity stripped is at a maximum, i.e. a minimal quantity of applicator mass is removed from reservoir vessel 12.

What I claim is:

1. Container for a mass applicator, comprising:

a reservoir vessel (12) having an opening;

a closure (14) for said opening;

an applicator (30) having an axis and having a periphery radial that is disposed at varying distances from said axis within the same plane at right angles to said axis, said applicator being movable along said axis to selectively immerse said applicator in said vessel and to selectively withdraw said applicator through said opening of said vessel;

an applicator mass stripper (80) for engaging a peripheral portion of said applicator, said applicator mass stripper being disposed in said vessel at a position where said stripper can engage said applicator as said applicator is withdrawn through said opening, the angle between a predetermined point on said stripper and a predetermined point on said periphery with respect to said axis being changeable to vary the engagement between said applicator and applicator mass stripper; and means, operationally connecting said applicator and said applicator mass stripper and providing at least one detent position between said applicator and applicator mass stripper, for providing at least one preselected angle between said predetermined point on said stripper and predetermined point on said periphery with respect to said axis.

2. Container according to claim 1, further comprising an apportioning stripper (60) in said vessel.

3. Container according to claim 2, further comprising a shaft (32) to support the applicator, the apportioning stripper (60) being disposed to strip the shaft.

4. Container according to claim 2, wherein both strippers (60, 80) are integrally connected and comprise a unitary element.

5. Container according to claim 2, wherein both strippers (60, 80) are arranged to be spatially separated from one another.

6. Container according to claim 2, wherein said vessel has a neck (18) communicating with said opening, and wherein both strippers (60, 80) are disposed in the neck.

7. Container according to claim 2, wherein at least one stripper (60, 80) is designed to be in one piece with the vessel.

8. Container according claim 1, wherein the cross section of the applicator (30) exhibits a plurality of sectors.

9. Container according to claim 8, wherein one of said sectors is a circular arc enclosing an angle of more than 180°.

10. Container according to claim 1, further comprising a shaft (32) connecting the closure and the applicator, and wherein the lateral spacing of the applicator from the stripper (80) is variable by rotating the closure.

11. Container according to claim 10, wherein the cross section of the applicator (30) has the shape of a circular arc and the axis of the applicator is arranged to be concentric with the closure.

12. Container according to claim 1, wherein the free passage cross section of the stripper (80) is similar to the cross section of the applicator (30).

13. Container according to claim 1, wherein the overlap area of stripper (80) and applicator (30) is variable.

14. Container according to claim 1, wherein the applicator (30) is a brush.

15. Container according to claim 1, wherein the applicator (30) is made of a material selected from the group consisting of sponge-like plastic and leather.

16. Container according to claim 1, wherein a thread (20) is provided for joining the closure to the vessel.

17. Container according to claim 16, further comprising an adjustable abutment for the thread (20).

18. Container according to claim 1 in which said container includes a cosmetic.

19. Container for a mass applicator, comprising:

a reservoir vessel (12) having an opening;

a closure (14) for said opening;

an applicator (30) having an axis and having a periphery that is disposed at varying radial distances from said axis within the same plane at right angles to said axis, said applicator being movable along said axis to selectively immerse said applicator in said vessel and to selectively withdraw said applicator through said opening of said vessel;

a shaft (32) connecting said closure and said applicator;

an applicator mass stripper (80) for engaging a peripheral portion of said applicator, said applicator mass stripper being disposed in said vessel at a position where said stripper can engage said applicator as said applicator is withdrawn through said opening, the angle between a predetermined point on said stripper and a predetermined point on said periphery with respect to said axis being changeable to vary the engagement between said applicator and applicator mass stripper; and at least one mark disposed on said closure to visually indicate at least one preselected angle between said predetermined point on said stripper and predetermined point on said periphery with respect to said axis.

20. Container according to claim 19, further comprising an apportioning stripper (60) in said vessel.

21. Container according to claim 20, wherein the apportioning stripper (60) is disposed to strip the shaft (32).

22. Container according to claim 20, wherein both strippers (60, 80) are integrally connected and comprise a unitary element.

23. Container according to claim 20, wherein both strippers (60, 80) are arranged to be spatially separated from one another.

24. Container according to claim 20, wherein said vessel has a neck (18) communicating with said opening, and wherein both strippers (60, 80) are disposed in the neck.

25. Container according to claim 28, wherein at least one stripper (60, 80) is designed to be in one piece with the vessel.

26. Container according to claim 19, wherein the cross section of the applicator (30) exhibits a plurality of sectors.

27. Container according to claim 26, wherein one of said sectors is a circular arc enclosing an angle of more than 180°.

28. Container according to claim 19, wherein the lateral spacing of the applicator from the stripper (80) is variable by rotating the closure.

29. Container according to claim 28, wherein the cross section of the applicator (30) has the shape of a circular arc and the axis of the applicator is arranged to be concentric with the closure.

30. Container according to claim 19, wherein the free passage cross section of the stripper (80) is similar to the cross section of the applicator (30).

31. Container according to claim 19, wherein the overlap area of stripper (80) and applicator (30) is variable.

32. Container according to claim 19, wherein the applicator (30) is a brush.

33. Container according to claim 19, wherein the applicator (30) is made of a material selected from the group consisting of sponge-like plastic and leather.

34. Container according to claim 19, wherein a thread (20) is provided for joining the closure to the vessel.

35. Container according to claim 34, further comprising an adjustable abutment for the thread (20).

36. Container according to claim 19 in which said container includes a cosmetic.

37. Container for a mass applicator, comprising:

a reservoir vessel having an opening;

a closure for said opening;

an applicator having an axis and having a periphery that is disposed at varying radial distances from said axis within the same plane at right angles to said axis, said applicator being movable along said axis to selectively immerse said applicator in said vessel and to selectively withdraw said applicator through said opening of said vessel; and an applicator mass stripper disposed in said vessel at a position where said stripper can engage said applicator for wiping a portion of the periphery thereof as said applicator is withdrawn through said opening, the angle between a predetermined point on said stripper and a predetermined point on said periphery with respect to said axis being changeable to vary the size of the portion of said periphery that is wiped.

38. Container according to claim 37, further comprising a shaft connecting said closure and said applicator, said shaft being disposed along said axis of said applicator, and an apportioning stripper disposed within said vessel between said opening and said applicator mass stripper to strip said shaft.

39. Container according to claim 38, wherein said vessel has a neck adjacent said opening, wherein at least one of said strippers is disposed in said neck, and wherein said vessel and at least one of said strippers are integrally connected and comprise a unitary element.

40. Container according to claim 39, wherein said neck has an axis, wherein said applicator mass stripper comprises means for defining a passageway having a first predetermined geometrical shape in a plane perpendicular to said axis of said neck, and wherein said periphery of said applicator has a second predetermined geometrical shape in a plane perpendicular to said axis of said applicator, said first and second geometric shapes being substantially congruent.

* * * * *